US007109429B1

(12) United States Patent
Lee

(10) Patent No.: US 7,109,429 B1
(45) Date of Patent: Sep. 19, 2006

(54) SWITCH ASSEMBLY

(76) Inventor: Fu-Hsiung Lee, No. 19-3, Lane 520, Sec. 1, Sheng Lin Rd., Ta Ya Hsiang, Taichung Hsien (TW)

( * ) Notice: Subject to any disclaimer, the term of this patent is extended or adjusted under 35 U.S.C. 154(b) by 0 days.

(21) Appl. No.: 11/368,490

(22) Filed: Mar. 7, 2006

(51) Int. Cl.
*H01H 1/26* (2006.01)
*H01H 1/28* (2006.01)

(52) U.S. Cl. ..... 200/283; 200/1 R; 200/341; 200/293; 439/441; 439/439

(58) Field of Classification Search ..... 439/441, 439/439; 200/283
See application file for complete search history.

(56) References Cited

U.S. PATENT DOCUMENTS 4,130,744 A * 12/1978 Beecher et al. ..... 200/1 A
5,626,488 A * 5/1997 Albeck et al. ..... 439/395
5,911,594 A * 6/1999 Baker et al. ..... 439/404
2002/0160648 A1* 10/2002 Bulmer et al. ..... 439/393

* cited by examiner

*Primary Examiner*—Elvin Enad
*Assistant Examiner*—Lheiren Mae A. Anglo
(74) *Attorney, Agent, or Firm*—Rosenberg, Klein & Lee

(57) ABSTRACT

A switch assembly has a base, a cover and multiple conductive slices. The base has an extending board and multiple inserting recesses. The inserting recesses are formed in the extending board and each have two mounting posts and an inserting hole. The mounting posts are formed on and protrude up from the recess. The inserting hole is formed through the extending board. The cover is mounted over the base. The conductive slices are attached to the inserting recesses and each has an elastic tab and a mounting tab. The mounting tab is contacted with the elastic tab, is attached to the inserting recess and has two mounting holes, an opening and two clamping slices. The mounting holes are formed through the mounting tab and correspond to the mounting posts. The opening is formed through the mounting tab and corresponds to the inserting hole. The clamping slices are attached to the mounting tab.

8 Claims, 5 Drawing Sheets

SWITCH ASSEMBLY

BACKGROUND OF THE INVENTION

1. Field of the Invention

The present invention relates to a switch assembly, and more particularly to a switch assembly that can connect with electric wires without a soldering process.

2. Description of Related Art

A conventional switch assembly is used as a bridge between a power source and an electric equipment and usually has a case, a conductive device, a button device and multiple conductive slices. The case has a cover and a base. The cover is securely mounted around the base and formed an inner chamber between the cover and the base. The conductive device is mounted in the inner chamber. The button device is attached to the cover and is contacted to the button device. The conductive slices are respectively attached to and protrude out from the base and are contacted to the conductive device.

When the switch assembly is assembled between the power source and the electric equipment, electric wires of the power source must be connected to the conductive slices of the switch assembly by a soldering process.

Even though the conventional switch assembly can be used as a bridge between the power source and the electric equipment, the conventional switch assembly also has the following shortcomings.

1. To assemble the switch assembly between the power source and the electric equipment, a soldering machine and the soldering material are necessary, and this will increase cost and time for assembling the switch assembly to the power source and the electric equipment.

2. With the soldering material for connecting the wires to the conductive slices, the switch assembly is not detachable to the wires so that to repair or change a damaged switch assembly is trouble and difficult.

SUMMARY OF THE INVENTION

The main objective of the present invention is to provide a switch assembly can connect with electric wires without a soldering process.

The switch assembly has a base, a cover and multiple conductive slices. The base has an extending board and multiple inserting recesses. The inserting recesses are formed in the extending board and each have two mounting posts and an inserting hole. The mounting posts are formed on and protrude up from the recess. The inserting hole is formed through the extending board. The cover is mounted over the base. The conductive slices are attached to the inserting recesses and each have an elastic tab and a mounting tab. The mounting tab is contacted with the elastic tab, is attached to the inserting recess and has two mounting holes, an opening and two clamping slices. The mounting holes are formed through the mounting tab and correspond to the mounting posts. The opening is formed through the mounting tab and corresponds to the inserting hole. The clamping slices are attached to the mounting tab.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
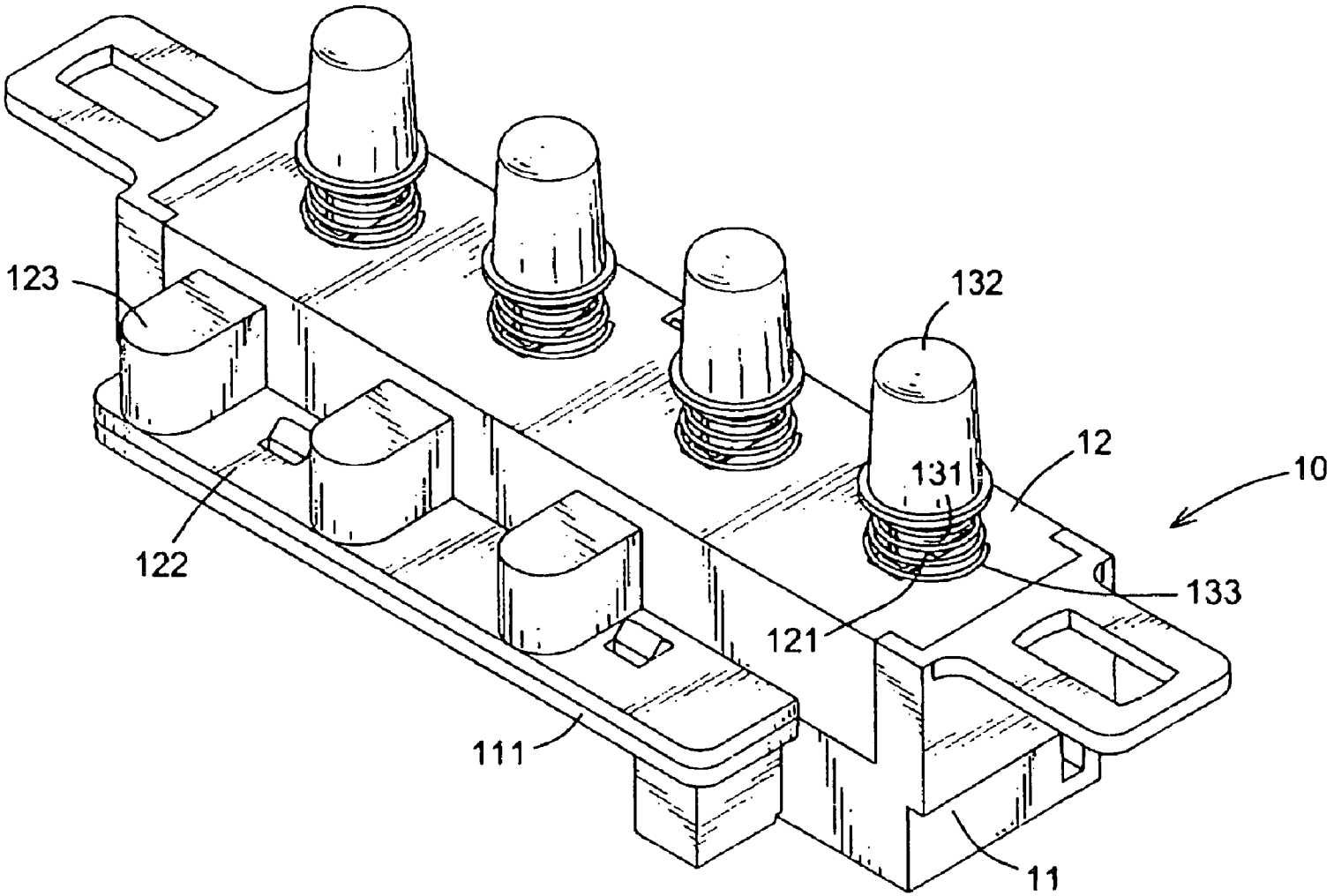
FIG. 1 is a perspective view of a switch assembly in accordance with the present invention.
Figure 2:
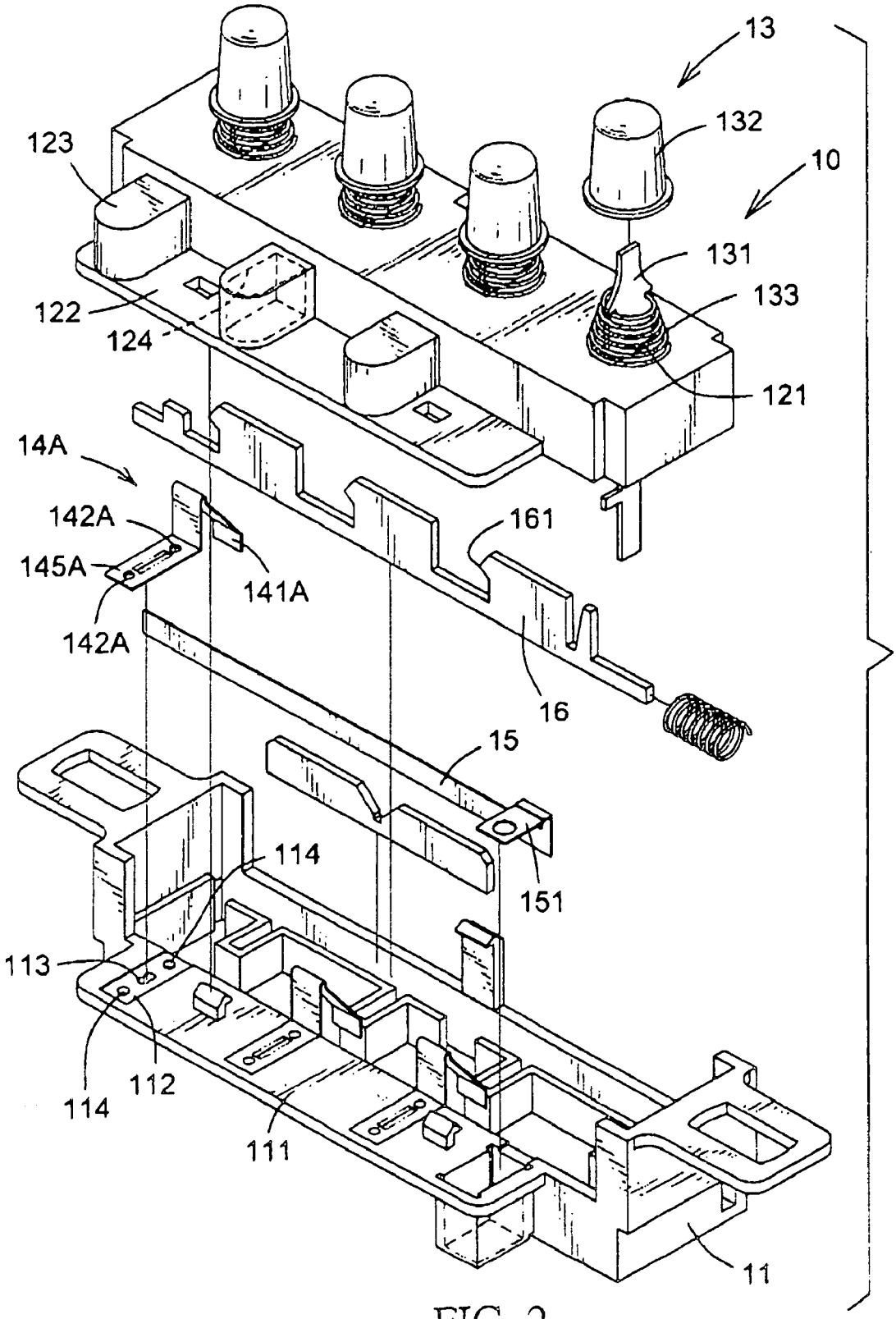
FIG. 2 is an exploded perspective view of the switch assembly in FIG. 1.
Figure 3:
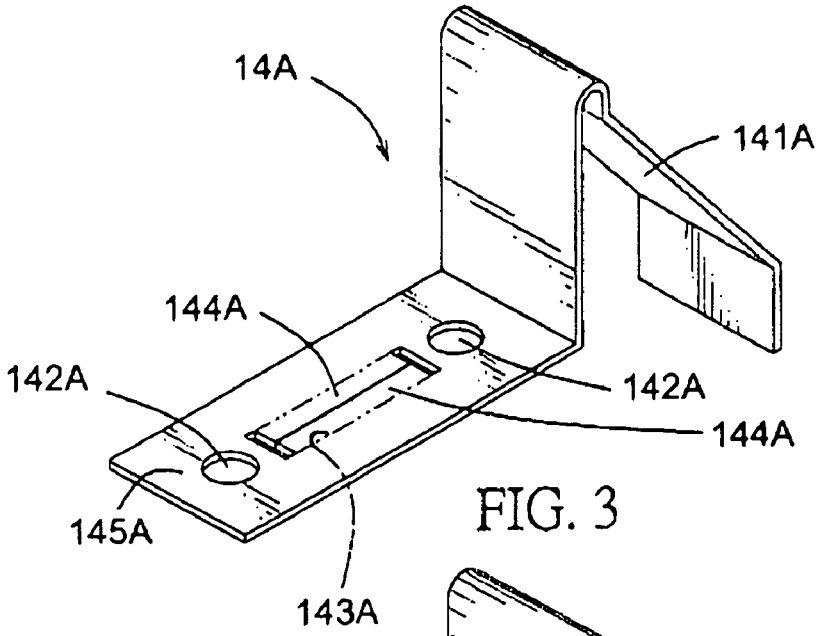
FIG. 3 is an enlarged perspective view of an embodiment of the conductive slice in FIG. 1.

With reference to FIGS. 1 to 3, a switch assembly (10) in accordance with the present invention comprises a base (11), a cover (12), multiple button devices (13), multiple conductive slices (14A) and may have a power slice (15) and an engaging board (16).

The base (11) is U-shaped and has a front side, a rear side, an extending board (111) and multiple inserting recesses (112). The extending board (111) is mounted horizontally on the front side of the base (11) and has a top and a bottom. The inserting recesses (112) are respectively formed in the top of the extending board (111) and each has two mounting posts (114) and an inserting hole (113). The mounting posts (114) are respectively formed and protrude up from the bottom of the recess (112). The inserting hole (113) is figured an eight-shape and is formed through a bottom of the recess (112) between the mounting posts (114).

The cover (12) is mounted over the base (11) and has a top, a front side, a rear side, multiple through holes (121), a connecting board (122) and multiple caps (123). The through holes (121) are respectively formed through the top of the cover (12). The connecting board (122) is mounted horizontally on the front side of the cover (12), corresponds to the extending board (111) and has a top surface and a bottom surface. The caps (123) are respectively mounted on the connecting board (122), correspond respectively to the inserting recesses (112) in the extending board (112) and each have an open end, a close end and a chamber (124). The open end of the cap (123) is extended from the top surface to the bottom surface of the connecting board (122) and covers around the corresponding inserting recess (112). The chamber (124) is formed between the open end and the close end of the cap (123).

The button devices (13) are respectively mounted on the cover (12) and each have a pressing tab (131), a button (132) and a spring (133). The pressing tab (131) is mounted on the cover (12), extends through one of the through holes (121) of the cover (12) and has a distal end and proximal end. The distal end of the pressing tab (131) is extended through a corresponding through hole (121). The button(132) is attached to the proximal end of the pressing tab (131). The spring (133) is mounted around the pressing tab (131) between the button (132) and the top of the cover (12).

The conductive slices (14A) are respectively attached to the inserting recesses (112) of the base (11) and each have an inner end, an outer end, an elastic tab (141A) and a mounting tab (145A). The elastic tab (141A) is bent to a triangular-shape and is formed on the inner end of the conductive slice (14A). The mounting tab (145A) is flat, is formed on the outer end, is attached to one of the inserting recesses (112) and has two mounting holes (142A), an opening (143A) and two clamping slices (144A). The mounting holes (142A) are respectively formed through the mounting tab (145A) and correspond respectively to the mounting posts (114) in the corresponding inserting recess (112). The opening (143A) is rectangular-shaped, is formed through the mounting tab (145A) between the mounting holes (142A) and corresponds to the inserting hole (113) in the corresponding inserting recess (112) and has two ends. The clamping slices (144A) are rectangular-shaped, are horizontally and respectively attached to the mounting tab (145A) over the opening (143A), face each other and formed a gap between the clamping slices (144A). The gap is communicated with the opening (143A).

The power slice (15) is mounted in the base (11) is contacted to the elastic tabs (141A) of the conductive slices (14A) and has an end and a connecting tab (151). The connecting tab (151) is formed in the end of the power slice (15) and is used to transport the electric power.

The engaging board (16) is mounted in the base (11) and is engaged with the distal ends of the pressing tabs (131).

Figure 4:
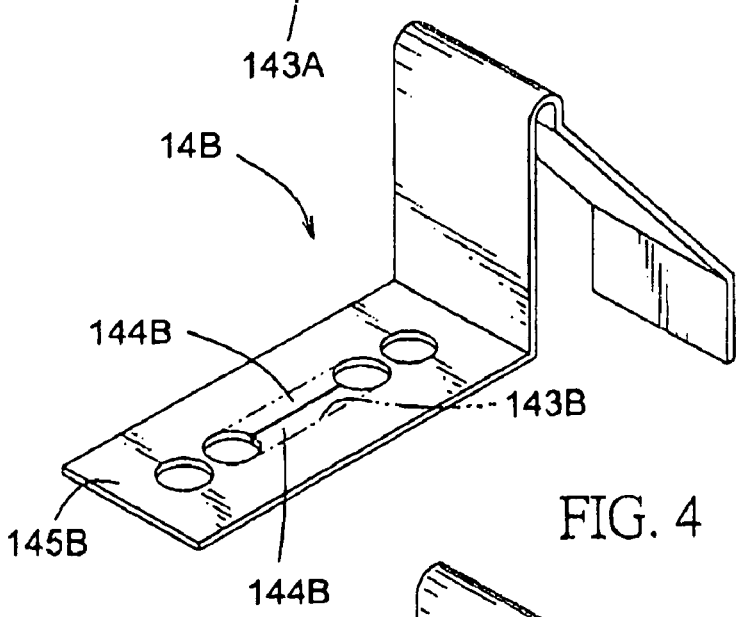
FIG. 4 is an enlarged perspective view of another embodiment of a conductive slice in accordance with the present invention.
Figure 5:
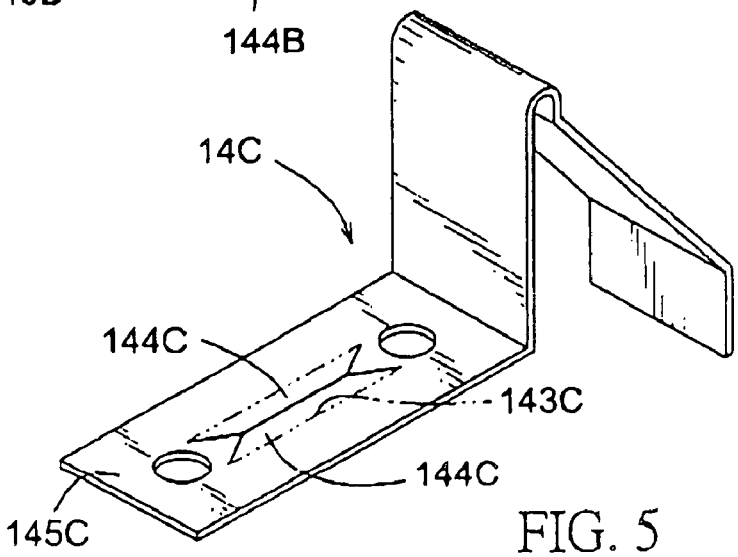
FIG. 5 is an enlarged perspective view of a further embodiment of a conductive slice in accordance with the present invention.

With reference to FIG. 4, another embodiment of a conductive slice (14B) in accordance with the present invention has a structure substantially same as that of the previous embodiment except that two circular hole are respectively formed through the clamping slices (144B) at the ends of the opening (143B), and communicated with the gap between the clamping slices (144B). With reference to FIG. 5, a further embodiment of a conductive slice (14C) in accordance with the present invention has a structure substantially same as that of the previous embodiment except that the ends of the opening (143C) are V-shaped and formed through the mounting tab (145C) and communicated with the gap between the clamping slices (144C).

Figure 6:
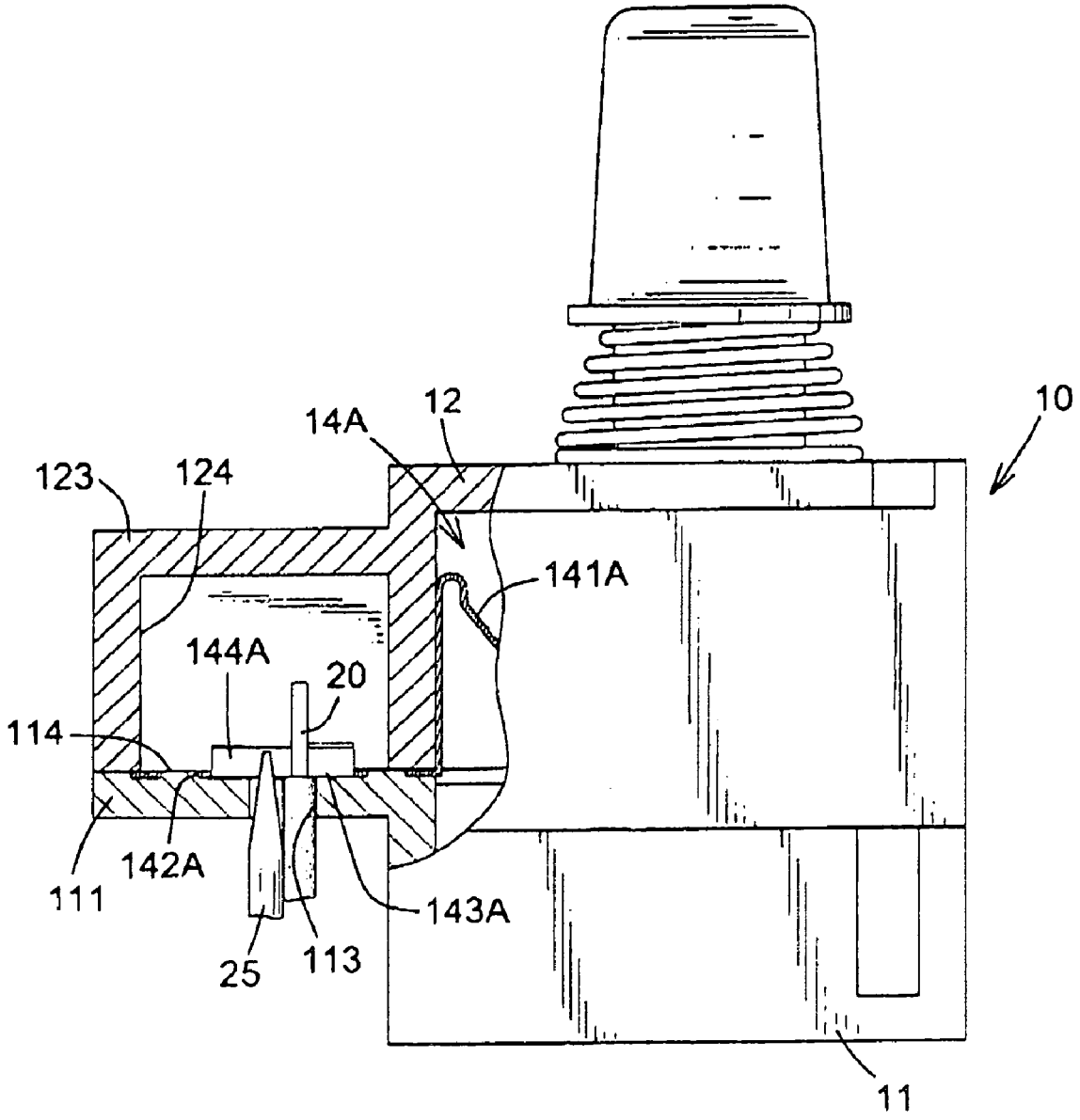
FIG. 6 is an operational side view in partial section of the switch assembly in FIG. 1.
Figure 8:
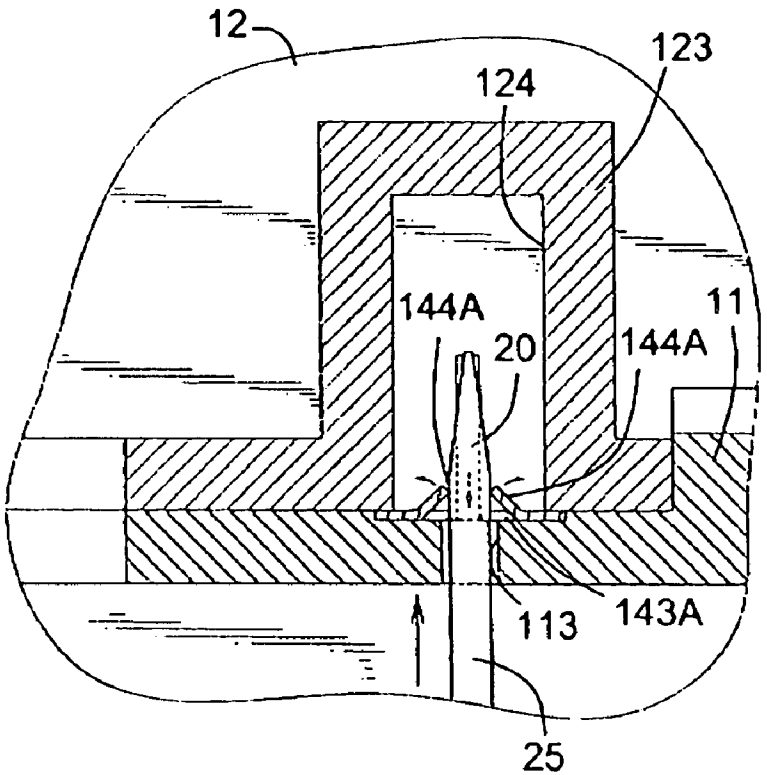
FIG. 8 is an enlarged operational side view of the electric wire separating from the conductive slice by the shaft in FIG. 1.
Figure 7:
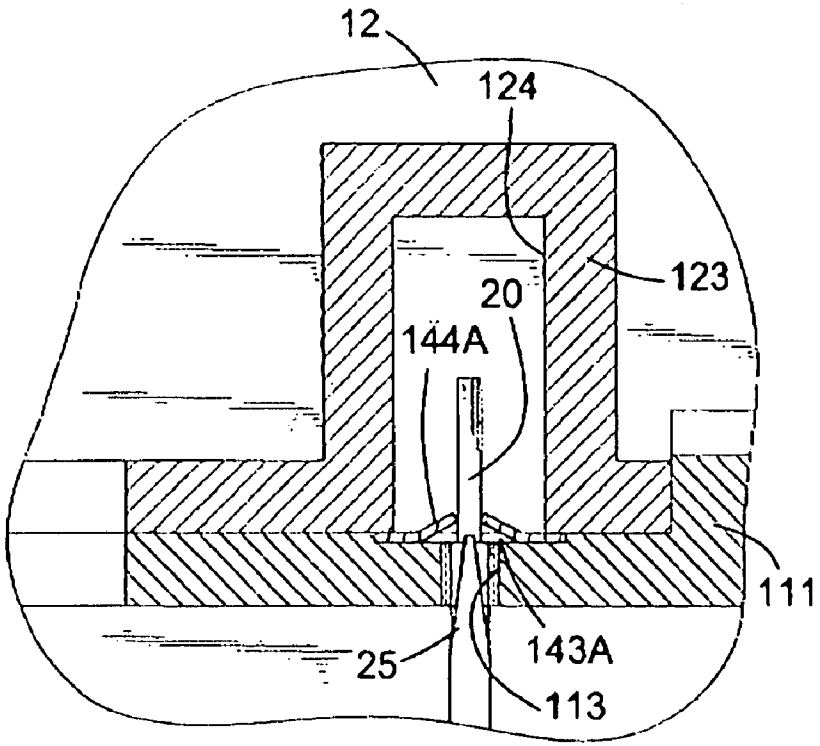
FIG. 7 is an enlarged operational side view of an electric wire separating from the conductive slice by a shaft in FIG. 1.

With reference to FIGS. 6 to 8, users can connect an electric wire (20) with the switch assembly (10) by inserting the electric wire (20) through one of the inserting holes (113) and being engaged with the clamping slices (144A, 144B, 144C) on the corresponding conductive slice (14A, 14B, 14C) without a soldering process. In addition, users can detach the electric wire (20) from the conductive slice (14A, 14B, 14C) by inserting a shaft (25) into the corresponding inserting hole (113) and pushing the clamping slices (144A, 144B, 144C) to release the electric wire (20) from the clamping slices (144A, 144B, 144C). Then, the electric wire (20) can pull out from the corresponding conductive slice (14A, 14B, 14C) to detach the wire (20) from the switch assembly (10).

The switch assembly (10) as described has the following advantages.

1. To assemble the switch assembly (10) with the electric wires (20), only to insert the electric wires (20) into and be engage with the conductive slices (14A, 14B, 14C) is necessary. Therefore, a soldering machine and soldering material are unnecessary, and the cost and the time for assembling the switch assembly (10) with electric wires (20) are reduced.

2. The simplified structure of the conductive slice (14A, 14B, 14C) causes the manufacturing of the switch assembly to be quicker and easier.

3. Because the electric wires (20) can be easily detached from the switch assembly (10), to repair or replace a damaged switch assembly is convenient.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the board general meaning of the terms in which the appended claims are expressed.

What is claimed is:

1. A switch assembly having
- a base being U-shaped and having
  - a front side;
  - a rear side;
  - an extending board mounted horizontally on the front side of the base and having
    - a top; and
    - a bottom; and
  - multiple inserting recesses respectively formed in the top of the extending board and each having
    - a bottom;
    - at least one mounting post formed on and protruding up from the bottom of the inserting recess; and
    - an inserting hole formed through the bottom of the inserting recess and the extending board;
- a cover mounted over the base; and
- multiple conductive slices respectively attached to the inserting recesses of the base and each having
  - an inner end;
  - an outer end;
  - an elastic tab being bent to a triangular-shape and formed on the inner end of the conductive slice; and
  - a mounting tab formed on the outer end of the conductive slice, attached to a corresponding inserting recess and having
    - at least one mounting hole formed through the mounting tab and respectively corresponding to an engaging with the at least one mounting post on the corresponding inserting recess;
    - an opening formed through the mounting slice and corresponding to the at least one inserting hole in the corresponding inserting recess and having two ends; and
    - two clamping slices horizontally and respectively attached to the mounting tab over the opening, facing each other and formed a gap between the clamping slices and communicating with the opening.

2. The switch assembly as claimed in claim 1, wherein the cover having
- a top;
- a front side;
- a rear side;
- multiple through holes respectively formed through the top of the cover;
- a connecting board mounted horizontally on the front side of the cover and corresponding to the extending board and having
  - a top surface; and
  - a bottom surface; and multiple caps respectively mounted on the connecting board, respectively corresponding to the inserting recesses on the extending board and each having an open end extended from the top surface to the bottom surface of the connecting board and covering around a corresponding one of the inserting recesses;

a close end; and a chamber formed between the open end and the close end of the cap.

3. The switch assembly as claimed in claim 2, wherein the opening is rectangular-shaped and each of the clamping slice is rectangular-shaped.

4. The switch assembly as claimed in claim 2, wherein two circular hole respectively formed through the clamping slices at the ends of the opening, and communicated with the gap between the clamping slices.

5. The switch assembly as claimed in claim 2, wherein the ends of the opening being V-shaped and formed through the mounting tab and communicated with the gap between the clamping slices.

6. The switch assembly as claimed in claim 1, wherein the opening is rectangular-shaped and each the clamping slice is rectangular-shaped.

7. The switch assembly as claimed in claim 1, wherein two circular hole respectively formed through the clamping slices at the ends of the opening, and communicated with the gap between the clamping slices.

8. The switch assembly as claimed in claim 1, wherein the ends of the opening being V-shaped and formed through the mounting tab and communicated with the gap between the clamping slices.

* * * * *